United States Patent [19]

Harris

[11] 4,092,038

[45] May 30, 1978

[54] JACKET WITH IMPROVED LIFTING MEANS

[75] Inventor: Robert S. Harris, Blytheville, Ark.

[73] Assignee: Brown & Root, Inc., Houston, Tex.

[21] Appl. No.: 769,170

[22] Filed: Feb. 16, 1977

[51] Int. Cl.[2] ..... B66C 1/34

[52] U.S. Cl. ..... 294/78 R; 294/74

[58] Field of Search ..... 294/78 R, 81, 81 SF, 294/74, 75, 82 AN, 87, 66, 113, 104; 403/234, 237, 310, 311, 312, 313, 49; 24/201 L

[56] References Cited

U.S. PATENT DOCUMENTS

| | | | |
|---|---|---|---|
| 3,451,711 | 6/1969 | Carpenter | 294/113 |
| 3,656,796 | 4/1972 | Cook | 294/78 R |
| 3,831,993 | 8/1974 | Drayton et al. | 294/78 P |
| 3,982,779 | 9/1976 | Hickey | 403/311 |

*Primary Examiner*—James B. Marbert
*Attorney, Agent, or Firm*—Kenway & Jenney

[57] ABSTRACT

A jacket for use in supporting an offshore platform. The jacket is of the type having a plurality of legs interconnected by a plurality of bracing members, a number of the bracing members having means for connection with the cables of apparatus for lifting the jacket during transportation and positioning thereof. The jacket has improved connection means comprising a plurality of self-aligning, reusable padeyes and a corresponding plurality of padeye mounting sites. Each mounting site comprises a cylindrical padeye receiving portion comprising a section of a bracing member, and is bounded axially by stop means. Each padeye comprises a pair of hinged, generally hemispherical clamp members which, when closed, form a cylindrical hollow sized to fit the receiving portion. An eyelet is rigidly mounted on each clamp member and defines a hole for receiving a pin and a stop surface. The axis of the hole in each eyelet is skewed with respect to the central axis of the hollow, and the stop surfaces mutually abut to limit the extent of closure of the clamp members, to maintain registration of the respective pin receiving holes, and to ensure that the padeye is free to axially rotate about the receiving portion.

In use, the padeyes are closed about padeye receiving portions spaced apart on one side of the jacket. With the stop surfaces in contact and the eyelet holes registered, the pin of a shackle is threaded through the eyelets, and cables are fixed to each shackle and to the main cable of a lift apparatus. When lifting commences, the padeyes rotate axially about the cylindrical receiving portion and become aligned such that they are subjected essentially to tensile stress only.

7 Claims, 7 Drawing Figures

7

7

JACKET WITH IMPROVED LIFTING MEANS

BACKGROUND OF THE INVENTION

This invention relates to a jacket for use in supporting an offshore platform, and more particularly to a jacket for supporting a drilling platform of the type having a plurality of legs interconnected by a plurality of bracing members, a number of the bracing members having means for connection with the cables of apparatus for lifting the jacket during transportation to and positioning at an offshore drilling site.

In the past, offshore platforms have been employed advantageously in a number of different marine situations. For instance, offshore platforms have been employed as supports for radar or sonar stations, light beacons, and various types of marine laboratories. Furthermore, offshore platforms have frequently been employed in the exploration for oil in an offshore environment. Use of such platforms in the exploration for oil has received increasing emphasis as supplies of petroleum indigenous to the major industrial countries have diminished.

Such offshore platforms are usually supported by jackets which rest on the sea bottom. Typically, the jackets are massive structures consisting of a plurality (often four) of legs long enough to extend from the ocean floor to the water surface and arranged to form a tower-like structure which tapers inwardly from bottom to top and is held together by a plurality of bracing members and reinforcing struts. The jackets are fabricated onshore from sections of tubular and other structural steel, and thereafter are transported via barges or floatation units to the drilling site for positioning. To assist in the transportation and positioning, the jackets are frequently fitted with padeyes designed to provide sites for connecting the cables of lift apparatus such as a crane.

When the size of these jacket structures and the severity of the environment in which they are used are appreciated, it becomes apparent that there is a need for means for connecting cables to the jacket which will be strong enough to hold the weight of the jacket structure, yet simple enough to enable installers to rapidly connect and disconnect cables as required.

In this regard, one practice has been to simply weld padeyes at selected points on one or more sides of the jacket to receive hooks or shackles fixed to the end of the lift cables. While this procedure has been generally satisfactory, it is time consuming and expensive. Such permanently fixed padeyes must be correctly positioned and welded to the jacket during its fabrication. Difficulties may be encountered in orienting the padeyes such that stresses of a magnitude sufficient to shear the welds or damage the jacket during the transportation and positioning procedure are avoided. Furthermore, once the jacket is positioned on the ocean floor, the padeyes are no longer useful.

Lifting is typically accomplished using one or more main cables which branch off to multiple cables, each of which is connected to a padeye appropriately located on one side of the jacket. In this situation, in order to relieve undue shear stresses in the padeyes, each one must be oriented on a bracing member such that a line passing through the central axis of the branching member and through the point of attachment of the cable to the padeye is coincident with the axis of the cable while under tension lifting. If the installer achieves this optimum orientation, the padeye is subjected only to a tensile stress.

However, the orientation of the cable during lifting is dependent on the dimensions of the jacket, the location of the padeye, and the length of the cable used to connect with the main cable. Because of inherent imprecision in estimating the final cable orientation and the consequent difficulty inherent in orienting the permently-mounted padeye properly, the prior art padeyes have been susceptible to a variety of fabrication and assembly problems.

SUMMARY OF THE INVENTION

In accordance with the invention, a jacket is provided for use in supporting an offshore platform of the type having a plurality of legs interconnected by a plurality of bracing members, a number of the bracing members having means for connection with the cables of apparatus for lifting the jacket. The jacket is provided with a plurality of improved connection means. Each connection means comprises a padeye mounting site and a self-aligning, reusable padeye. The mounting sites comprise a section of a bracing member which defines a cylindrical padeye receiving portion, bounded axially by stop means. The padeye comprises a pair of hinged, generally hemispherical clamp members which, when closed, form a cylindrical hollow sized to fit the receiving portion, and has a central axis. An eyelet is rigidly mounted on each clamp member. Each eyelet has a hole for receiving the pin of a shackle and a stop surface. The axis of the eyelet holes is skewed with respect to the central axis of the hollow. When the clamp members are closed, the stop surfaces engage to limit the extent of closure of the clamp members, to register the pin receiving holes, and to ensure that the padeye is free to rotate axially about the receiving portion.

The padeye is operable, when fitted about the receiving portion, to rotate about the central axis of the hollow in response to tension applied on the eyelet pin by a cable of the lift apparatus. During lifting, the central axis of a cable connected to the padeye intersects with the central axis of the hollow so that shear, torsion and bending stresses in the padeye are eliminated or minimized.

In preferred embodiments, the improved jacket with lifting means includes a shackle for receiving the cables of the lift apparatus which has a pin for being threaded through the pin receiving holes; four connection means are provided on the jacket and are spaced apart on corner portions of one side thereof; the stop means comprises a plurality of raised portions extending radially from the bracing member; the eyelets are mounted on the clamp members by a plurality of gusset plates, at least one of which extends about the circumference of the clamp member further than 90° from the eyelet; and the hinge comprises a set of hinge plates mounted on each clamp member and rotatable connected by a rod.

Accordingly, it is an object of the invention to provide a jacket having improved cable connection means which comprises a reusable and a self-aligning padeye.

Another object of the invention is to provide a padeye for use in lifting a jacket which may be simply and rapidly connected and disconnected during transportation and positioning of the jacket.

Another object of the invention is to provide a padeye which may be fixed to a jacket without welding or using securing bolts.

Still another object of the invention is to provide a cooperative jacket and padeye structure such that, during lifting of the jacket, the axis of the cables connected to the padeyes intersect with the central axis of the bracing members on which the padeyes are mounted, thereby eliminating or minimizing shear stresses on the padeye.

Other objects and features of the invention will be apparent to those skilled in the art from the following description of a preferred embodiment and from the drawing.

DESCRIPTION OF A PREFERRED EMBODIMENT

Figure 1:
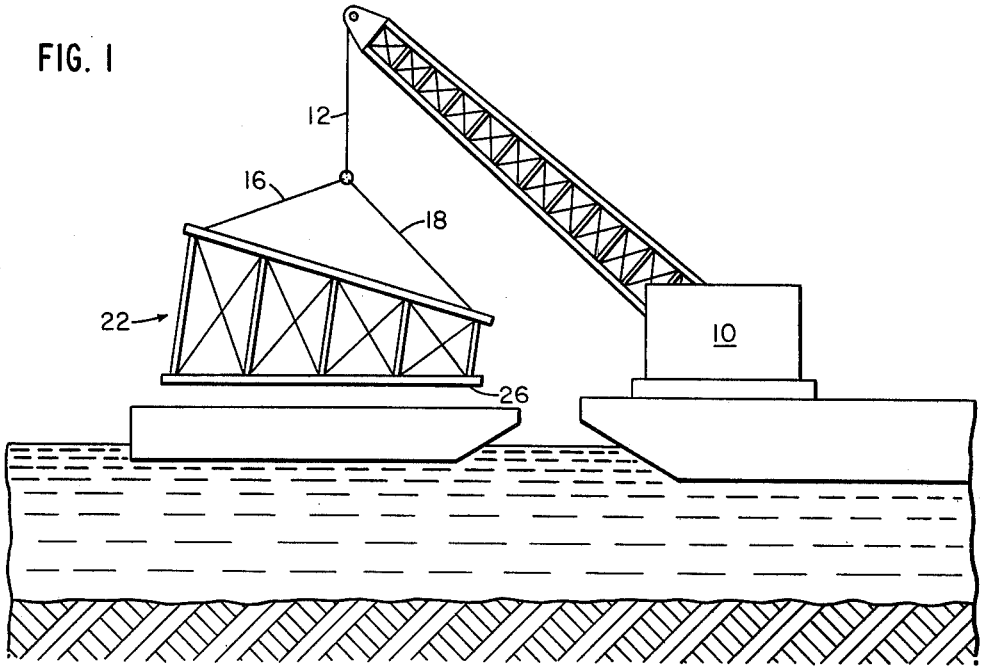
FIG. 1 is a schematic view of a crane lifting a jacket.

Referring to the drawing, a crane 10 mounted on a barge is illustrated as having a main cable 12 which branches into four cables 14, 16, 18, and 20, attached respectively to the four corners of one side of a jacket 22. The jacket comprises four legs designated 24, 26, 28, and 30, which taper inwardly and are interconnected by a plurality of bracing members 32. To provide structural rigidity, the jacket has a network of struts, schematically illustrated at 34.

Figure 2:
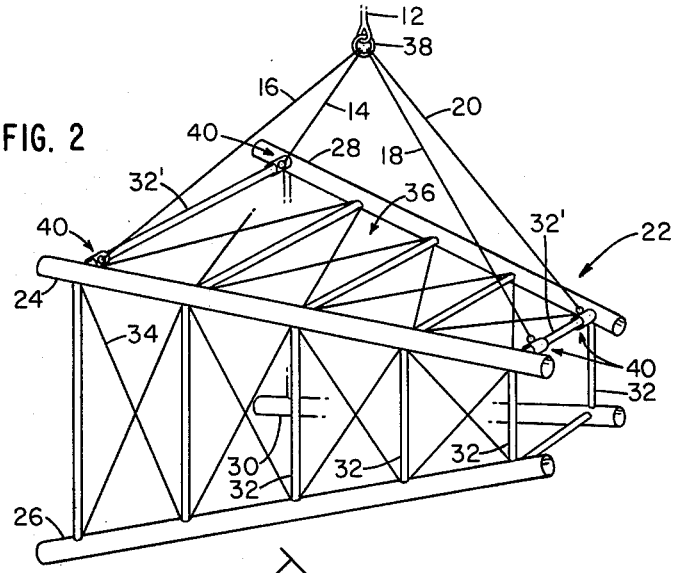
FIG. 2 is a perspective view of a preferred cable arrangement used with the jacket and improved connection means of the invention.

FIG. 2 illustrates one preferred cable configuration which may be employed in lifting the jacket 22. It should be noted, however, that the jacket with improved connection means may be suitably modified for use with other cable arrangements utilizing, for example, more than one main cable. Accordingly, the invention will be described with reference to the illustrated cable arrangement by way of example only and should not be limited thereto.

As can be seen from FIG. 2, each branching cable 14, 16, 18, and 20 is oriented at an angle to the plane of one side 36 of the jacket 22, which angle is primarily determined by the dimensions of the jacket, and the distance between the side 36 and the point of attachment 38 of the four cables to the main cable 12. From the drawing, the difficulty of predicting the cable orientation during lifting with respect to a particular bracing member to which it will be connected, e.g., the orientation of cable 20 to bracing member 32', can be appreciated. Accordingly, it can be appreciated that it is difficult to weld a padeye onto a bracing member in an orientation such that, when a cable is attached to the padeye and lifting commences, the axis of the cable will pass through the central axis of the bracing member, thus minimizing or eliminating shear forces on the padeye.

In accordance with the invention, a novel connection means is provided which is self-aligning, i.e., automatically orients itself to the optimum angle with respect to the bracing member to which it is attracted during lifting.

The connection means comprises a padeye 44 and a padeye mounting site 40. Mounting sites are located (FIG. 2) adjacent the four corners of one side of the jacket 22. Each mounting site comprises a cylindrical padeye receiving portion 41 which is bounded axially by a stop means 42. The stop means 42 preferably takes the form of a plurality of raised portions projecting radially from the bracing member at a point spaced from the jacket legs, e.g., 24 and 28, to which the padeye will be attached.

Figure 3:
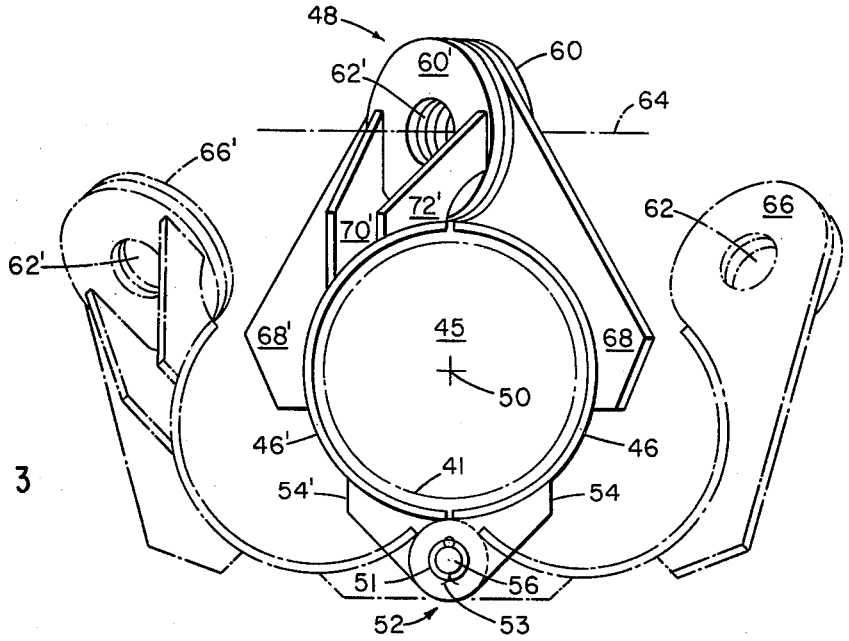
FIG. 3 is an end elevation view of a preferred embodiment of a padeye useful with the invention showing the open position in phantom.
Figure 4:
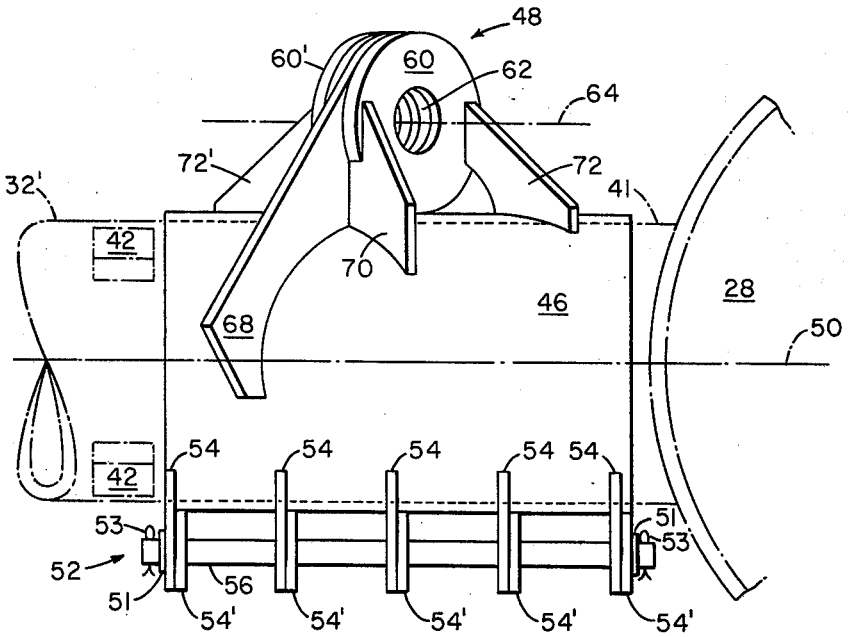
FIG. 4 is an elevation view of the padeye of FIG. 3.
Figure 5:
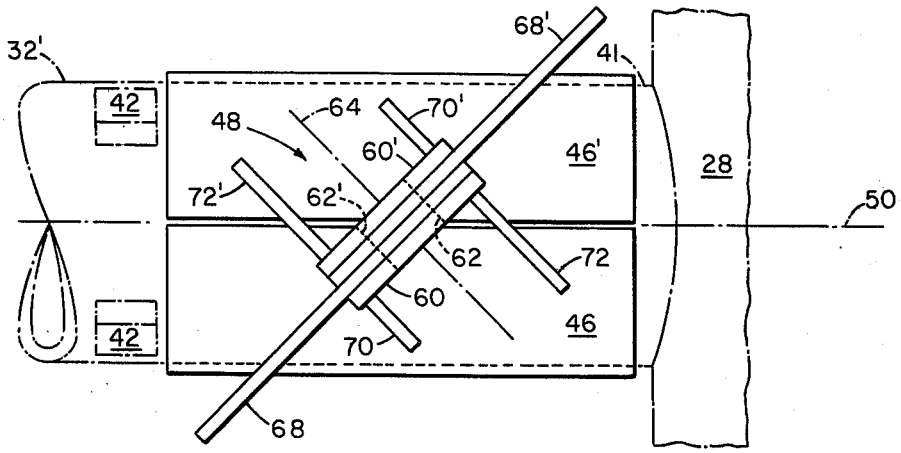
FIG. 5 is a top plan view of the padeye of FIG. 3.

A preferred embodiment of the padeye 44 is shown in detail mounted on a receiving portion 41 in FIGS. 3, 4, and 5. The padeye comprises generally hemispherical clamp members 46, 46', connected by a hinge 52 which, when closed, forms a cylindrical hollow 45 having a central axis 50. The hinge comprises two sets of hinge plates 54, 54', integral respectively with clamp members 46, 46', and rotatably connected by a rod 56. Locking washers 51 and pins 53 prevent axial movement of the rod.

Figure 7:
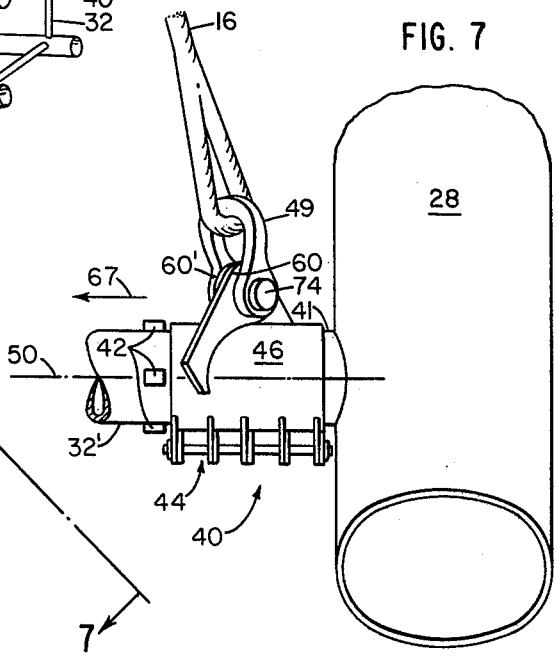
FIG. 7 is a simplified detailed view of the padeye of FIG. 6 taken at line 7—7.
Figure 6:
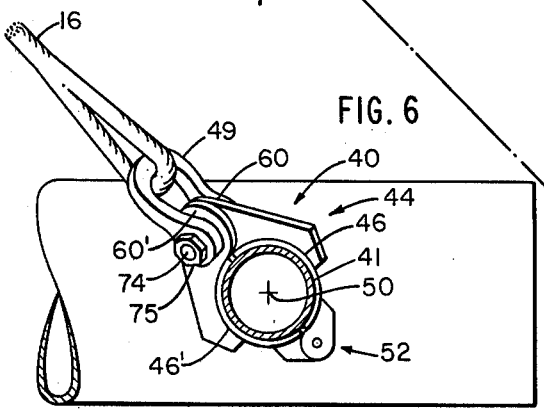
FIG. 6 is a simplified detailed view of a padeye useful with the invention in its orientation during lifting.

An eyelet structure 48 is mounted on the clamp members opposite the hinge. Structure 48 comprises a pair of eyelets 60, 60', mounted, respectively, on clamp members 46, 46'. Each eyelet has a hole 62, 62', and a stop surface 66, 66'. When the clamp members are closed, the surfaces 66, 66', abut, and the holes 62, 62' register to have a common axis 64. The abutment of stop surfaces 66, 66' limits the extent of closure of the clamp members 46, 46' so that, in use, the padeye does not bind on the receiving portion 41 and thus is free to rotate about axis 50. As can best be seen in FIG. 5, axis 64 is skewed with respect to the axis 50 of the hollow 45. Each eyelet 60, 60' is mounted on its respective clamp member 46, 46' by a plurality of gusset plates designated 68, 70, 72, and 68', 70', and 72'. The gusset plates are integral with the clamp member and at least one, e.g., 68, extends about the circumference of the clamp member further than 90° from the eyelet 60. When a pin 74 of a shackle 49 (see FIGS. 6 and 7) are positioned through eyelet structure 48, the clamp members are maintained in the closed position and tension on a cable fastened to the shackle can only serve to maintain this position.

In operation, four padeyes of the type disclosed above are opened as shown in phantom in FIG. 3 and placed around the receiving portion 41 of bracing member, e.g., 32', of the jacket 22. The padeyes are mounted by closing clamp members 46, 46' until the stop surfaces 66, 66' abut and the holes 62, 62' are registered. A pin 74 is inserted through the registered holes and a shackle 49 is secured to the pin by a nut 75. At this point, the cylindrical hollow formed by the clamp members is filled by the receiving portion 41, and the axis 50 of the hollow 45 and the axis of the receiving portion are coincident. Padeye 44 is thus free to rotate about axis 50, but stop means 42 and the jacket leg 28 prevent substantial axial movement.

When all padeyes are mounted as described, branch cables are connected to the shackles and lifting commences. As a branch cable 16 comes under tension, the padeyes rotate about axis 50 to automatically attain the proper angle with respect to the legs 24 and 28 (see FIG. 6). The angle of the hole axis 64 is such that a shear stress component generated in the direction of arrow 67, i.e., parallel to axis 50, is kept to a minimum.

When removal of the padeyes is called for, tension is removed from the cables, nut 75 is unthreaded and the pin and shackle are removed. The padeye is opened and removed for future use.

Thus, it can be seen that the invention provides a jacket with improved cable connection means that is self-aligning and features a padeye which may be reused a number of times. Further, the angle of the hole axis 64 and the rotation feature cooperate to minimize shear, torsion, and bending force components on the padeye so that essentially the only stress applied to the padeye is a tensile stress. Furthermore, no fasteners need be used save for the conventional shackle and associated pin, which serve to maintain the closed position of the padeye.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a jacket for use in supporting an offshore platform having a plurality of legs interconnected by a plurality of bracing members, a number of said bracing members having means for connection with the cables of apparatus for lifting the jacket during transportation and positioning thereof, the improvement wherein said connection means comprises:

a padeye mounting site on said bracing member comprising a cylindrical, padeye receiving portion bounded axially on at least one side by stop means; and a self-aligning, reusable padeye for connection with said receiving portion comprising a pair of hemispherical clamp members joined by a hinge, said clamp members, when closed, forming a cylindrical hollow sized to rotatably fit about said receiving portion and having a central axis, and an eyelet rigidly mounted on each said clamp member defining a hole for receiving a pin, the axis of the hole in each said eyelet being skewed with respect to said central axis, said eyelets having stop surfaces for limiting the extent of closure of said clamp members so as to provide said rotatable fit and for maintaining registration of the pin receiving holes in said eyelets when said clamp members are closed, said padeye being operable to rotate about said central axis in response to force applied by the cable of the lift apparatus attached to said padeye so that, during lifting, the stress on the padeye has minimal shear components.

2. The improved jacket of claim 1 wherein said connection means further comprises a shackle for receiving a cable and a pin threaded through the registered pin receiving holes, said pin being operable to maintain the closed position of said padeye.

3. The improved jacket of claim 1 wherein four of said improved connection means are spaced apart on corner portions of one side of said jacket.

4. The improved jacket of claim 1 wherein said stop means comprises a raised portion extending radially from said bracing member.

5. The improved jacket of claim 1 wherein said eyelets are mounted on said clamp members by a plurality of gusset plates integral with said clamp members.

6. The improved jacket of claim 5 wherein a gusset plate extends about the circumference of said clamp member further than 90° from said eyelet.

7. The improved jacket of claim 1 wherein said hinge comprises a set of hinge plates integral with each said clamp member and a rod rotatably connecting said sets.

* * * * *